US008061097B2

(12) United States Patent
Holt et al.

(10) Patent No.: US 8,061,097 B2
(45) **Date of Patent: *Nov. 22, 2011**

(54) INSULATED SIDING SYSTEM

(75) Inventors: John Timothy Holt, Akron, OH (US); Patrick M. Culpepper, Massillon, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/044,935

(22) Filed: Mar. 10, 2011

(65) Prior Publication Data

US 2011/0154760 A1 Jun. 30, 2011

Related U.S. Application Data

(63) Continuation of application No. 12/367,693, filed on Feb. 9, 2009, now Pat. No. 7,954,292.

(60) Provisional application No. 61/096,368, filed on Sep. 12, 2008.

(51) Int. Cl.

| | |
|---|---|
| ***E04D 1/00*** | (2006.01) |
| ***E04D 1/28*** | (2006.01) |
| ***E04D 1/34*** | (2006.01) |
| ***E04B 2/00*** | (2006.01) |

(52) U.S. Cl. ..... 52/309.7; 52/309.8; 52/309.16; 52/506.05; 52/520; 52/539; 52/546; 52/582.1; 52/592.1

(58) Field of Classification Search ..... 52/309.7, 52/309.8, 309.16, 506.05, 539, 520, 521, 52/546, 552, 582.1, 592.1

See application file for complete search history.

(56) References Cited

U.S. PATENT DOCUMENTS

| | | | | |
|---|---|---|---|---|
| 2,021,922 | A | 11/1935 | Peck | |
| 2,216,206 | A | 10/1940 | McKee, Jr. | |
| 2,328,977 | A | 9/1943 | Hasenburger et al. | |
| 2,442,977 | A | 6/1948 | Sandor | |
| 2,961,804 | A | 11/1960 | Beckman | |
| 3,158,960 | A | 12/1964 | Newton et al. | |
| 3,479,784 | A | 11/1969 | Massagli | |
| 3,535,840 | A | 10/1970 | Fontana | |
| 3,706,172 | A | 12/1972 | Keith | |
| 3,998,021 | A | 12/1976 | Lewis | |
| 4,034,528 | A | 7/1977 | Sanders et al. | |
| 4,037,377 | A | 7/1977 | Howell et al. | |
| 4,065,902 | A | 1/1978 | Lindal | |
| 4,100,711 | A * | 7/1978 | Skuran | 52/489.2 |
| 4,104,840 | A | 8/1978 | Heintz et al. | |
| 4,184,301 | A | 1/1980 | Anderson et al. | |
| 4,195,459 | A | 4/1980 | Anderson | |
| 4,299,069 | A | 11/1981 | Neumann | |
| 4,320,613 | A | 3/1982 | Kaufman | |
| 4,327,528 | A | 5/1982 | Fritz | |

(Continued)

*Primary Examiner* — Robert Canfield
(74) *Attorney, Agent, or Firm* — Fay Sharpe LLP; Richard M. Klein

(57) ABSTRACT

An insulated siding panel comprises a foam insulation layer, an attachment member, and optionally a veneer layer. The foam insulation layer comprises a front face, a rear face, a tongue along a first end edge, a groove along a second end edge, and a slot defined in the rear face. The attachment member comprises an attachment rail and a member extending transversely from the attachment rail. The member of the attachment member is inserted into the slot of the foam insulation layer. When present, the veneer layer is attached to the front face of the foam insulation layer. When joined with other insulated siding panels, the interlocking occurs along the foam insulation layers to form an unbroken layer of insulation.

19 Claims, 3 Drawing Sheets

U.S. PATENT DOCUMENTS 4,407,104 A 10/1983 Francis
4,506,486 A 3/1985 Culpepper et al.
4,641,473 A 2/1987 Trezza
5,016,415 A 5/1991 Kellis
5,092,095 A 3/1992 Zadok et al.
5,343,665 A 9/1994 Palmersten
5,425,210 A 6/1995 Zafir
5,448,865 A 9/1995 Palmerston
5,502,939 A 4/1996 Zadok et al.
5,598,677 A 2/1997 Rehm, III
5,799,462 A 9/1998 McKinney
5,893,248 A 4/1999 Beliveau
6,029,415 A 2/2000 Culpepper et al.
6,122,877 A 9/2000 Hendrickson et al.
6,298,626 B2 10/2001 Rudden
6,314,701 B1 11/2001 Meyerson
6,321,500 B1 11/2001 Manning et al.
6,922,964 B2 8/2005 Pervan
6,968,659 B2 11/2005 Boyer
7,040,067 B2 5/2006 Mowery et al.
7,186,457 B1 3/2007 Zehner et al.
7,188,454 B2 3/2007 Mowery et al.
7,467,500 B2 12/2008 Fairbanks et al.
7,762,040 B2 * 7/2010 Wilson et al. ..... 52/748.1
7,908,814 B2 * 3/2011 Wilson et al. ..... 52/519
2001/0010139 A1 8/2001 De Kerpel et al.
2002/0007608 A1 1/2002 Pervan
2002/0095894 A1 7/2002 Pervan
2003/0024199 A1 2/2003 Pervan et al.
2003/0084636 A1 5/2003 Pervan
2005/0081468 A1 * 4/2005 Wilson et al. ..... 52/528
2006/0053716 A1 * 3/2006 Mowery et al. ..... 52/309.8
2006/0053740 A1 * 3/2006 Wilson et al. ..... 52/745.09
2006/0075712 A1 4/2006 Gilbert et al.
2007/0011976 A1 1/2007 Mowery et al.
2007/0193177 A1 8/2007 Wilson et al.
2007/0261353 A1 11/2007 Cullen
2009/0241459 A1 10/2009 Bryan

* cited by examiner

INSULATED SIDING SYSTEM

CROSS-REFERENCE TO RELATED APPLICATIONS

This application is a continuation of U.S. patent application Ser. No. 12/367,693, filed Feb. 9, 2009, now U.S. Pat. No. 7,954,292. U.S. patent application Ser. No. 12/367,693 claims priority to U.S. Provisional patent application Ser. No. 61/096,368, filed on Sep. 12, 2008. These applications are hereby fully incorporated by reference herein.

BACKGROUND

The present disclosure relates to insulated siding panels for use on the exterior of a building, such as a house. Methods and processes for making and/or using such insulated siding panels are also disclosed.

In a building structure, such as a house, a frame is typically built. An exterior wall of plywood or material of similar function is then placed upon the frame to provide an exterior surface. A weatherproofing layer may cover the exterior wall. An insulation layer can then be placed, and finally a cladding, paneling, sheathing, veneer, or siding is placed to provide the final exterior view.

Vinyl siding is a popular substitute for wood paneling and aluminum siding. It is easily cleaned, and it is resistant to deterioration. It may also be easily installed around windows and doors. Moreover, it may be produced in a variety of shapes and colors by known extrusion and molding processes at a relatively low cost per sheet or panel.

To enhance the thermal insulation of building structures, one or more layers of insulating material can be placed between the vinyl siding and the exterior wall of the building. For example, a layer of insulation can be placed on a exterior wall, and the vinyl siding then installed over the insulating layer. In other insulated siding systems, an insulated panel is generally attached to a veneer, such as a vinyl siding panel.

It would be desirable to produce additional insulated siding panel systems or assemblies that allow for simple production and easy installation and greater insulating properties.

BRIEF DESCRIPTION

The present application discloses, in various exemplary embodiments, insulated siding panels for use on the exterior surfaces or walls of a building. The insulated siding panels contain foam insulation, which provides strength, enables a wide variety of design options, and provides increased R-values.

Disclosed in embodiments is an insulated siding panel comprising a foam insulation layer and an attachment member. The foam insulation layer comprises a front face, a rear face, a first joining element defined in a first end edge, and a second joining element defined in a second end edge. The attachment member is mounted to the rear face and extends beyond the first end edge. The first and second joining elements are substantially complementary in shape so that adjacent panels can engage each other. For example, one joining element is a tongue and the other joining element is a groove. The foam insulation layer may further comprise a recess in the rear face along the second end edge.

The attachment member may comprise a main portion and a male connecting member extending approximately transversely from the main portion. The main portion may comprise one or more fastener receptacles.

In some embodiments, the attachment member comprises a plurality of male connecting members, the foam insulation layer comprises a plurality of female connecting members, and each male connecting member extends into a female connecting member.

The main portion may further comprise a curved section spaced from the male connecting member. The curved section cooperates with a section of the rear face of the foam insulation layer having a complementary shape.

The foam insulation layer may be formed from a polystyrene, polyurethane, polyisocyanurate, polyethylene, polypropylene, or combinations thereof.

In some embodiments, the insulated siding panel further comprises a veneer layer attached to the front face of the foam insulation layer. The veneer layer may include a channel cooperating with a lip of the front face of the foam insulation layer. A first end edge of the veneer layer may not extend beyond the first end edge of the foam insulation layer. However, a second end edge of the veneer layer may extend beyond the second end edge of the foam insulation layer. The veneer layer may also comprise a flexible seal extending downwards and outwards from a first front end edge of the veneer layer.

The veneer layer can be formed from vinyl, polypropylene, a fiber-cement material, aluminum, steel, a wood-plastic composite, a cementitious coating, wood, or combinations thereof.

The foam insulation layer may be denser at both the first end edge and the second end edge, compared to a center region of the foam insulation layer.

Also disclosed in embodiments is an insulated siding panel comprising an foam insulation layer and an attachment member. The foam insulation layer comprising a front face, a rear face, a tongue extending from a first end edge, a groove extending into a second end edge, and at least one slot defined in the rear face. The attachment member comprises a main portion and a flange extending approximately transversely from the main portion. The flange of the attachment member is inserted into the at least one slot of the foam insulation layer so the attachment member extends beyond the first end edge of the foam insulation layer.

Disclosed in still other embodiments is an insulated siding panel comprising an foam insulation layer, an attachment member, and a veneer layer. The foam insulation layer comprises a front face, a rear face, a tongue extending from an upper edge, a groove extending into a lower edge, and at least one slot defined in the rear face. The attachment member comprises a main portion, an attachment rail, and a flange extending approximately transversely from the main portion. The flange of the attachment member is inserted into the at least one slot of the foam insulation layer so the attachment rail extends beyond the upper edge of the foam insulation layer. The veneer layer is attached to the front face of the foam insulation layer, and an upper edge of the veneer layer does not extend beyond the upper edge of the foam insulation layer.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
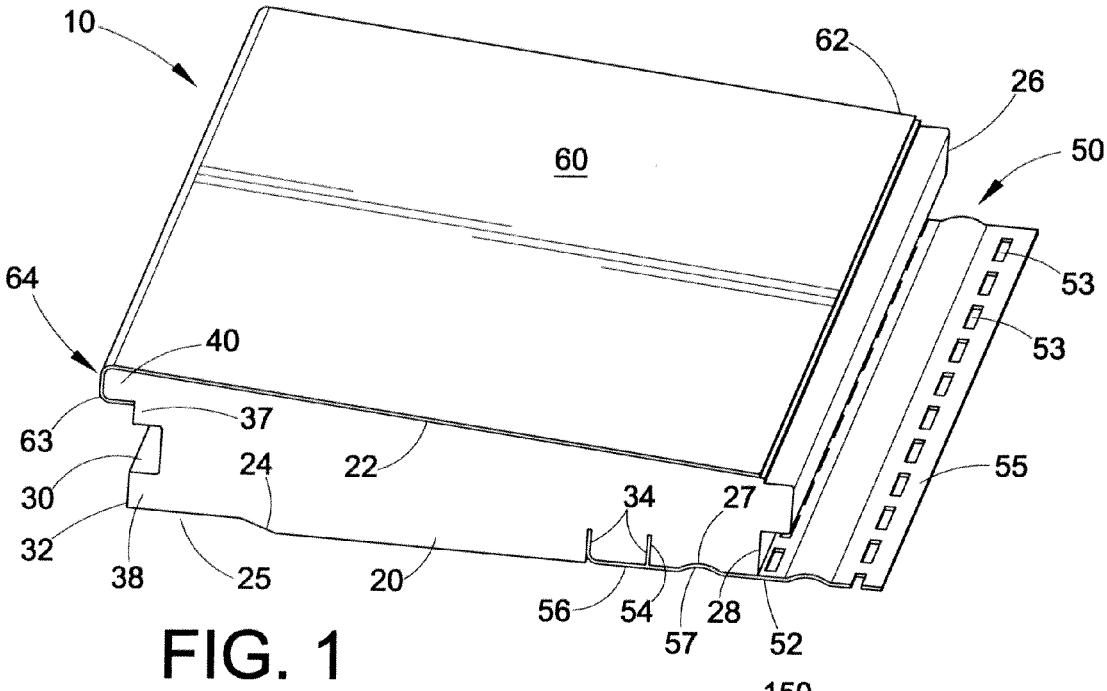
FIG. 1 is a perspective view of a first exemplary embodiment of an insulated siding panel according to the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Referring to FIG. 1, an insulated siding panel 10 comprises a foam insulation layer 20, an attachment member 50, and a veneer layer 60. The foam insulation layer 20 comprises a front face 22 and a rear face 24. A tongue, protrusion, or first joining element 26 is defined in a first end edge 28. A groove, rabbet, or second joining element 30 is defined in a second end edge 32. The first joining element 26 and second joining element 30 are substantially complementary in shape so that adjacent panels can engage each other (see FIGS. 3, 5, and 6). In some embodiments, the joining elements, which are complementary shapes, may also form a seal. As shown here, the first and second joining elements form a tongue-and-groove engagement. At least one slot, channel, groove, or female connecting member 34 is defined in the rear face 24.

The attachment member 50 comprises a main portion 52 and at least one flange, ridge, or male connecting member 54 extending approximately transversely from the main portion. The male connecting member 54 generally extends from a bottom portion 56 of the main portion 52. A top portion of the main portion may comprise, for example, an attachment rail 55 comprising one or more openings or fastener receptacles 53. A curved portion 57 is spaced from the male connecting member 54 and cooperates with a section 27 of the rear face 24 having a complementary shape. This curved portion aids in rigidizing the attachment member. The male connecting member 54 of the attachment member 50 is inserted into the female connecting member 34 of the foam insulation layer 20. The veneer layer 60 is attached to the front face 22 of the foam insulation layer 20.

The front face 22 may be contoured as desired. The main portion 52 of the attachment member 50 generally extends beyond the first end edge 28. The rear face 24 is generally flat or planar, but can include a recess 25 sized to accept the main portion 52 of the attachment member. When insulated siding panels are stacked on top of one another, the attachment rail 55 can fit in the recess 25. The first female connecting member 30 may be considered as being defined by front shoulder 37 and rear shoulder 38.

The veneer layer 60 and the attachment member 50 are attached to the foam insulation layer 20. They can be attached in a variety of ways including, but not limited to, adhesive, chemical bonding, interlocking complementary surfaces, and/or fasteners. For example, the attachment member may be pressed into the foam insulation layer. Typically, however, adhesives are used. The adhesive may be used over the entire surface of the veneer layer or attachment member, or used in discrete locations. Suitable adhesives may include, but are not limited to, UV curable adhesives and hot melt adhesives, such as polyamines and urethanes, glue, thermosetting or thermoplastic adhesives, pressure sensitive adhesives or solvent-based adhesives. Alternatively, the attachment member may be embedded in the foam insulation layer during the shape molding process, as described further below. The attachment member 50 may be located to allow the insulated siding panel 10 to be fastened to the wall without creating penetrations in the veneer layer 60 or the foam insulation layer 20.

In FIG. 1, the foam insulation layer 20 further comprises a lip 40 extending from the second end edge 32 along the front face 22. The veneer layer 60 has a first end edge 62 and a second end edge 64. An inwardly opening channel 63 is located along the second end edge 64, and the lip 40 is received into the channel 63. The shape of the channel may vary. The channel is not needed and is absent in some embodiments.

Figure 2:
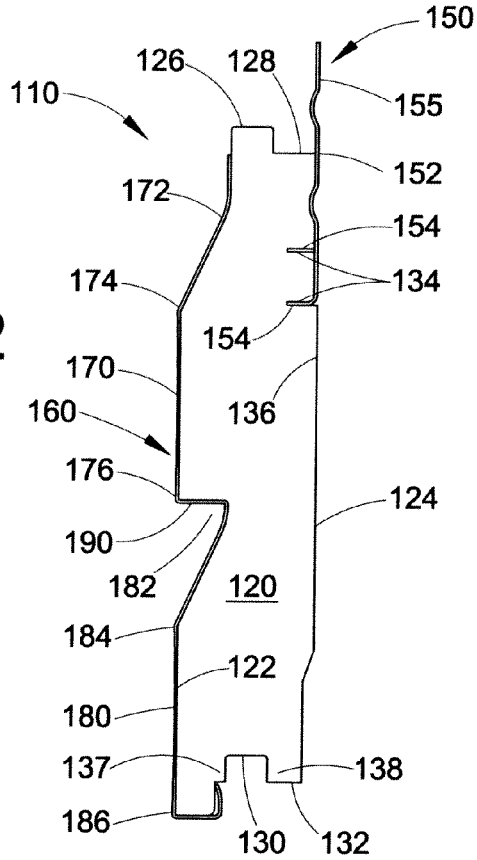
FIG. 2 is a side view of a second exemplary embodiment of an insulated siding panel according to the present disclosure.

Referring to FIG. 2, an insulated siding panel 110 comprises a foam insulation layer 120, an attachment member 150, and a veneer layer 160. The foam insulation layer 120 comprises a front face 122, a rear face 124, a tongue 126 extending from an upper edge 128, a groove 130 extending into a lower edge 132, and a plurality of slots 134 along an upper portion 136 of the rear face 124. The attachment member 150 comprises an attachment rail 155 and a plurality of flanges 154 extending approximately transversely from a main portion 152 of the attachment member. Each flange 154 of the attachment member 150 is inserted into a slot 134 in the foam insulation layer 120. The veneer layer 160 is attached to the front face 122 of the foam insulation layer 120. The groove 130 can be considered as being defined by or between front shoulder 137 and rear shoulder 138.

In the embodiment shown in FIG. 2, the veneer layer 160 comprises an upper wall 170, a lower wall 180, and a platform 190. Each wall 170, 180 has an upper edge 172, 182; a middle portion 174, 184; and a lower edge 176, 186. Each wall 170, 180 is also angled such that the upper edge 172, 182 is not in a plane defined by the middle portion 174, 184 and the lower edge 176, 186. The platform 190 joins the lower edge 176 of the upper wall 170 with the upper edge 182 of the lower wall 180.

Figure 3:
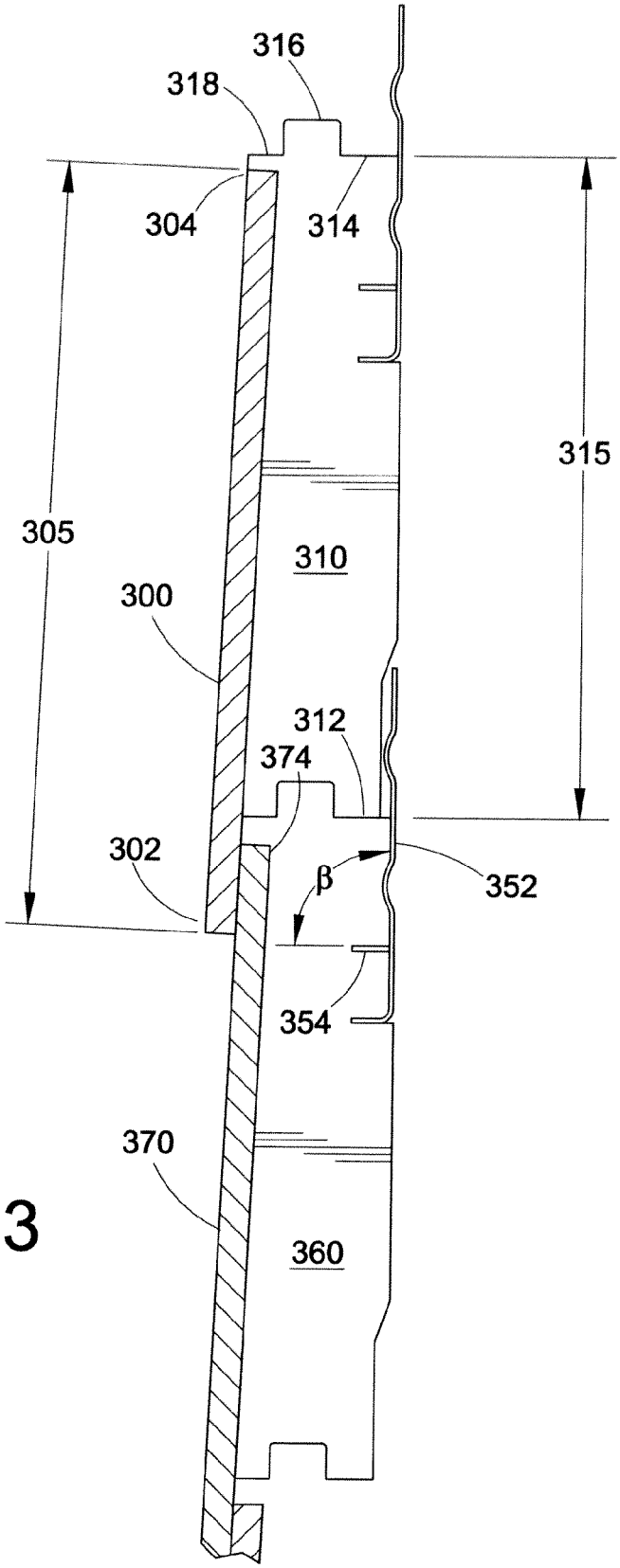
FIG. 3 is a side view of two insulated siding panels of a third exemplary embodiment according to the present disclosure joined together.

The veneer layer is generally placed as desired on the front face of the foam insulation layer. Referring to FIG. 3, the veneer layer 300 can be a flat panel. A second end edge 302 of the veneer layer can extend beyond the second end edge 312 of the foam insulation layer 310. A first end edge 304 of the veneer layer generally does not extend beyond the first end edge 314 or the first joining element 316 of the foam insulation layer 310, though it may as long as the complementary joining relationship of the first and second joining elements is not impacted. In addition, the first end edge 314 may form a ledge 318 over the first end edge 304 of the veneer layer 300.

Figure 4:
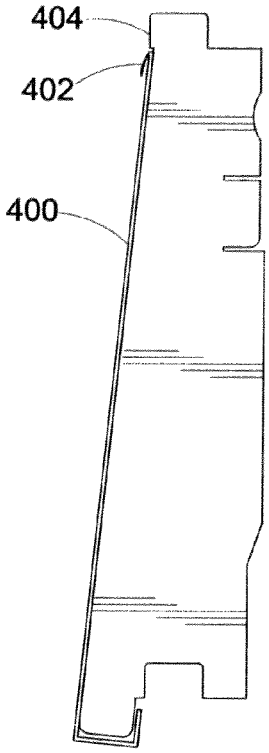
FIG. 4 is a side view of a fourth exemplary embodiment of an insulated siding panel according to the present disclosure.

In other embodiments as seen in FIG. 4, the veneer layer 400 may comprise a flexible seal 402 extending downwards and outwards from a first front end edge 404 of the veneer layer. This flexible seal may reduce the amount of water and/or wind that can enter between the seams of two insulated siding panels, for example if a homeowner is washing the veneer and directs water from a hose at an angle between the two insulated siding panels. The flexible seal may also aid in connecting insulated siding panels together by providing a tapering surface.

Any male/female connecting relationship may be used for the various joining elements and connecting members. For example, the tongue 126 and groove 130 relationship shown in FIG. 2 corresponds to the first joining element 26 and the second joining element 30 of FIG. 1. Put in other words, a tongue may extend from one end edge of the foam insulation layer and a groove may extend into the other end edge of the foam insulation layer. Similarly, for the attachment member, the flange 154 and slot 134 relationship shown in FIG. 2 corresponds to the male connecting member 54 and the female connecting member 34 of FIG. 1. There is no requirement that all male/female connecting members have the same size, shape, or relative dimensions.

The foam insulation layer may comprise a plurality of female connecting members 34 or slots 134 in the rear face. As seen in FIG. 1, not all slots must be used. However, the attachment member may comprise a plurality of male connecting members 54 or flanges 154 extending approximately transversely from the attachment member, wherein each male connecting member 54 or flange 154 of the attachment member is inserted into a female connecting member 34 or slot 134. When there are a plurality of female connecting members or slots, they do not all need to be oriented in the same direction or at the same angle, though generally they are. Similarly, the male connecting members or flanges do not all need to be oriented in the same direction or at the same angle.

Referring to FIG. 3, the male connecting member 354 and the main portion 352 of the attachment member may form any angle β which allows the attachment member to be mounted to the rear face of the foam insulation layer. This angle β is not particularly critical and may range from about 20° to about 160°. However, angles between about 45° and about 135° are preferable. In particular embodiments, the male connecting member and the main portion of the attachment member are oriented substantially perpendicular to each other. In different words, the male connecting member extends substantially perpendicularly from the main portion of the attachment member.

The foam insulation layer may be shape molded. Such molding operations will generally impart the desired contours and/or design to the foam insulation layer. Typically, beads and/or pellets of a polymeric precursor material, such as pre-expanded polystyrene, are placed in a suitably configured die mold, then reacted in the presence of water and heat (i.e. steam) to expand during the reaction process. The polymeric precursor material expands and presses against the die surface to form compressed elongated closed cells that form a characteristic tough smooth skin. The shape molded process produces a panel that is essentially straight and/or free of camber. During this process, if desired, the attachment member may be embedded in the insulation panel as it is expanded, such that no secondary fasteners are needed.

The foam insulation layer provides structural integrity to the insulated siding panel. For example, the foam insulation layer is the platform to which the veneer layer and the attachment member are connected. The foam insulation layer may be shaped to provide the desired profile for the overall insulated siding panel. For example, the shape of the foam insulation layer may be obtained by computer numerical control (CNC) cutting. The grooves on the rear face may also be milled or wire-cut.

The foam insulation layer is generally made from a cellular foam product, i.e. a plastic or polymeric material with numerous cells of trapped air distributed throughout its mass. For example, expanded polystyrene (EPS) is a cellular foam plastic made from beads of polystyrene beads that are first pre-expanded and allowed to rest for a suitable interval, then molded in closed steam-heated shaped molds to produce closed-cell molded foams. The size and density of the closed cells can be controlled and may vary depending upon the application. Suitable materials for the foam insulation layer can include extruded polystyrene (XPS), expanded polystyrene (EPS), polyurethane, polyisocyanurate, polyethylene, polypropylene, or combinations thereof. In some embodiments, the foam insulation layer is made from a rigid foam material.

The foam insulation layer can be of any density desired, or be tuned to provide different densities depending on the location. For example, it may be desirable to have higher densities near the edges of the panel, and lower densities near the center (where the veneer layer covers the foam insulation layer). In particular embodiments, the foam insulation layer has a higher density along the first end edge or upper edge than in the center of the foam insulation layer (i.e. the middle region of the foam insulation layer between the first end edge and the second end edge). Similarly, the foam insulation layer may also have a higher density along the second end edge or lower edge than in the center of the foam insulation layer. In other words, the foam insulation layer may be thought of as having a top region, a bottom region, and a middle region, and the middle region has a lower foam density than at least one of the top region and the bottom region, and possible both regions. This increased foam density can strengthen the joining areas of the foam insulation layer.

Expanded or extruded polystyrene are particularly desirable materials for the foam insulation layer because they provide a solid feel; improve the R-value; deaden noise transmitted through the siding; and allow moisture to migrateaway from the exterior wall into the external environment, protecting the exterior wall behind the foam insulation layer and reducing the risk of mold growth.

The veneer layer is optional and is not present in all embodiments, but is generally desired. The veneer layer provides environmental resistance and durability. It is contemplated that the veneer layer is generally contoured to conform to the contours of the foam insulation layer. Generally, siding must be thick to resist sagging and retain the desired shape. However, the foam insulation layer allows the veneer layer to be thinner than otherwise necessary. The veneer layer only has to provide weatherability to the insulated siding panel. Whereas traditional vinyl veneer sidings have a minimum material thickness of 0.040 inches, the veneer layers used in this disclosure may have a thickness from 0.020 to 0.036 inches.

The veneer layer can be formed from any suitable polymeric, metallic, cementious or composite material. Exemplary materials include vinyl, polypropylene, fiber-cement material, polyolefins, polyvinyls, polycarbonates, polyacetals, polysulfones, polyesters, polyamides, multilayer films, polyethylene (HDPE), polypropylene, low density polyethylene (LDPE), CPVC ABS, ethyl-vinyl acetate, various extruded ionomeric films, polyethylene based films, wood, or combinations thereof. Other siding materials suitable for the veneer layer include wood, aluminum, and steel.

Figure 5:
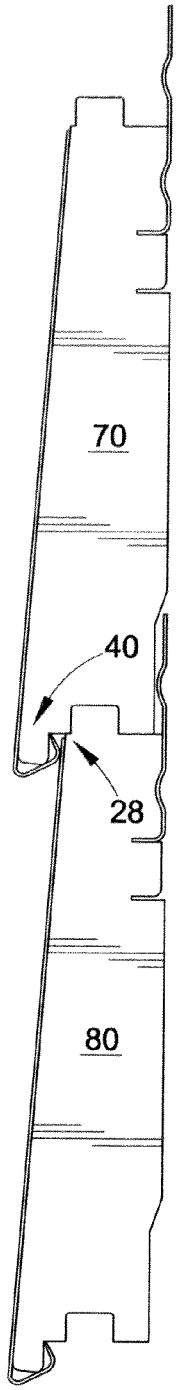
FIG. 5 is a side view showing two insulated siding panels according to the first exemplary embodiment of FIG. 1 joined together.
Figure 6:
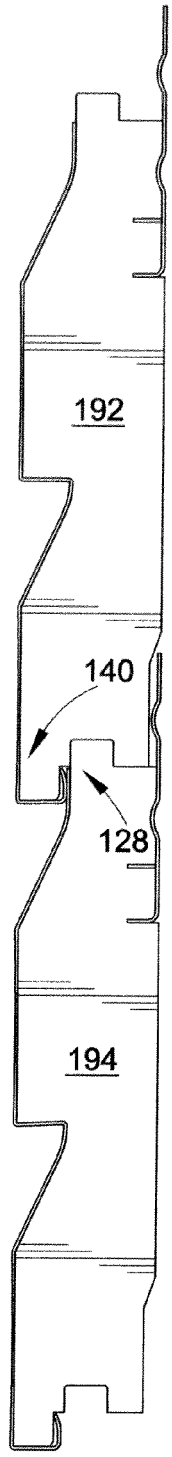
FIG. 6 is a side view showing two insulated siding panels according to the second exemplary embodiment of FIG. 2 joined together.

Generally, the bottom of each insulated siding panel will overlap the top of the insulated siding panel below it. As seen in FIGS. 5 and 6, a lip 40, 140 of the top foam insulation layer 70, 192 will extend beyond the first end edge 28 or upper edge 128 of the bottom foam insulation layer 80, 194. As shown in FIG. 3, the second end edge 302 of the top veneer layer 300 of panel 310 extends beyond the first end edge 374 of the bottom veneer layer 370 of panel 360; in other words, the veneer layers overlap. The front face 22 and rear face 24 are generally not parallel with each other to provide this overlapping feature. The construction of the insulated siding panel creates a uniform barrier from the foam insulation layers 70, 80.

Again referring to FIG. 3, the veneer layer 300 will have a height 305 which is measured between the first end edge 304 and second end edge 302. Similarly, the foam insulation layer 310 will have a height 315 which is measured between the first end edge 314 and second end edge 312. In some specific embodiments, the height 305 of the veneer layer is greater than the height 315 of the foam insulation layer.

The insulated siding panel can have a length of between 36 inches and 240 inches and will typically have lengths of 144 to 240 inches, as desired or required. The insulated siding panel will be essentially straight and free from camber and bowing. The insulated siding panel can have a width of between 7 and 48 inches, with typical widths between 8 and 36 inches in various applications. The insulated siding panel can have a total thickness of from about 0.2 to about 10 inches.

If desired, the rear face of the foam insulation layer may also have drainage grooves formed or fabricated into it. Such grooves are described in U.S. Patent Publication Nos. 2005/0081468 and 2007/0175154, the disclosures of which are hereby fully incorporated by reference.

The insulated siding panels are used in suitable combinations to be affixed to or attached to exterior walls of a building. They can be used on several types of structures including, but not limited to, wood-frame, cement block, structural insulated panels (SIPS), insulating concrete forms (ICFs), steel studs, etc. When installed, the resulting insulation layer is uniform and forms a complete seal. In addition, any perforations in the wall are sealed off from outside elements by the insulation. The attachment member also provides fewer perforations overall in the exterior wall. The foam insulation layers and veneer layers themselves are not perforated either. Nails, screws, or staples can be used with equal ease and can be more accurately placed and are more secure because they are applied directly to the exterior wall instead of through a flexible insulation layer.

Other benefits of the insulated siding panels described herein relate to production. The amount of insulation can be increased by simply adding more foam, without any other cost in materials. A single foam insulation layer can be used with multiple veneer layers to provide desired assemblies. The veneer layer can be reduced in thickness, reducing waste.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An insulated siding panel comprising:

a foam insulation layer comprising a front face, a rear face, a first joining element defined in a first end edge, a second joining element defined in a second end edge, a recess in the rear face along the second end edge, and a female connecting member in the rear face;

a veneer layer attached to the front face of the foam insulation layer; and an attachment member comprising a main portion, a male connecting member extending approximately transversely from the main portion into the female connecting member, and an attachment rail extending beyond the first end edge;

wherein the first and second joining elements are substantially complementary in shape so that adjacent panels can engage each other, and optionally wherein adjacent panels form a seal.

2. The insulated siding panel of claim 1, wherein one of the joining elements is a tongue and the other joining element is a groove.

3. The insulated siding panel of claim 1, wherein the male connecting member extends substantially perpendicularly from the main portion.

4. The insulated siding panel of claim 1, wherein the foam insulation layer is formed from a polystyrene, polyurethane, polyisocyanurate, polyethylene, polypropylene, or combinations thereof.

5. The insulated siding panel of claim 1, wherein the veneer layer further comprises a channel cooperating with a lip of the front face of the foam insulation layer.

6. The insulated siding panel of claim 1, wherein a first end edge of the veneer layer does not extend beyond the first end edge of the foam insulation layer.

7. The insulated siding panel of claim 1, wherein a second end edge of the veneer layer extends beyond the second end edge of the foam insulation layer.

8. The insulated siding panel of claim 1, wherein the veneer layer comprises a flexible seal extending downwards and outwards from a first front end edge of the veneer layer.

9. The insulated siding panel of claim 1, wherein the veneer layer is formed from vinyl, polypropylene, a fiber-cement material, aluminum, steel, a wood-plastic composite, a cementitious coating, wood, or combinations thereof.

10. The insulated siding panel of claim 1, wherein adjacent panels form a seal.

11. The insulated siding panel of claim 4, wherein the polystyrene is expanded polystyrene.

12. The insulated siding panel of claim 4, wherein the polystyrene is extruded polystyrene.

13. The insulated siding panel of claim 1, wherein the veneer layer has a thickness of from 0.020 inches to 0.036 inches.

14. The insulated siding panel of claim 1, wherein insulated siding panel has a length of between 36 inches and 240 inches.

15. The insulated siding panel of claim 1, wherein the insulated siding panel has a length of 144 inches to 240 inches.

16. The insulated siding panel of claim 1, wherein the insulated siding panel has a width of between 7 inches and 48 inches.

17. The insulated siding panel of claim 1, wherein the insulated siding panel has a width of between 8 and 36 inches.

18. The insulated siding panel of claim 1, wherein the insulated siding panel has a total thickness of from about 0.2 inches to about 10 inches.

19. An insulated siding panel, comprising:

a foam insulation layer comprising a front face, a rear face, a first joining element defined in a first end edge, a second joining element defined in a second end edge, and a recess in the rear face along the second end edge;

a veneer layer attached to the front face of the foam insulation layer; and an attachment member mounted to the rear face and extending beyond the first end edge;

wherein the first and second joining elements are substantially complementary in shape so that adjacent panels can engage each other, and optionally wherein adjacent panels form a seal; and wherein the rear face of the foam insulation layer comprises drainage grooves.

* * * * *